United States Patent [19]

Morisod

[11] Patent Number: 4,776,831

[45] Date of Patent: Oct. 11, 1988

[54] DEVICE FOR FOLDING FLAPS OF A BOX BLANK AND MAINTAINING THE FOLDED FLAP

[75] Inventor: Jean-Bernard Morisod, Crissier, Switzerland

[73] Assignee: Bobst SA, Switzerland

[21] Appl. No.: 37,890

[22] Filed: Apr. 13, 1987

[30] Foreign Application Priority Data

Apr. 18, 1986 [CH] Switzerland ..... 1564/86

[51] Int. Cl.[4] ..... B31B 1/58

[52] U.S. Cl. ..... 493/142; 493/181; 493/423; 493/441

[58] Field of Search ..... 493/141, 142, 144, 181, 493/182, 183, 422, 423, 441, 453, 460, 461, 465, 466

[56] References Cited

U.S. PATENT DOCUMENTS

| | | | |
|---|---|---|---|
| 1,641,970 | 9/1927 | Henderson | 493/142 |
| 1,903,243 | 3/1933 | Peck | 493/423 |
| 3,229,596 | 1/1966 | Hottendorf | 493/423 |
| 3,285,144 | 11/1966 | Frei | 493/453 |
| 3,618,479 | 11/1971 | Shields | 493/144 |

FOREIGN PATENT DOCUMENTS

| | | | |
|---|---|---|---|
| 1363690 | 7/1963 | France | 493/441 |

*Primary Examiner*—Frederick R. Schmidt
*Assistant Examiner*—William E. Terrell
*Attorney, Agent, or Firm*—Hill, Van Santen, Steadman & Simpson

[57] ABSTRACT

A device supported on a tubular frame and having a vertical cheek supporting pulleys including drive pulley and tension pulley, a belt having a circular cross section running over these pulleys and cooperating with a lower conveyor to fold parts of a composite flap of a box blank as the blank passes therebeneath. Depending on the construction of the box blank, several cheeks with associated pulleys and belts can be positioned above the conveyor conveying the blanks therethrough. Preferably, the belt has a circular cross section and moves at a linear speed approximately the same as the conveyor of the device.

5 Claims, 7 Drawing Sheets

DEVICE FOR FOLDING FLAPS OF A BOX BLANK AND MAINTAINING THE FOLDED FLAP

BACKGROUND OF THE INVENTION

The present invention is directed to a device for folding the flaps of a box blank and maintaining the folded flaps. The device has upper and lower side conveyors, a central lower conveyor, and an arrangement for folding composite front and rear flaps and also simple flaps. The present invention is also directed to a device for maintaining the simple or composite flaps in their folded positions for a box blank which are called boxes with six glue points by persons skilled in the art.

One of the known devices for the folding of the front flaps of a box is made of several hooks positioned along the running direction of each of the box flaps. These hooks are identical to the ones described in Swiss Pat. No. 383 140 corresponding to U.S. Pat. No. 3,285,144 and engage the front flap and folds it over as the blank moves under the hooks. The folding of the rear flap is also performed with a device provided with hooks which are rotated and hit a rear part of the blank. The device for folding the rear flaps is described in Swiss Pat. No. 464 671. The folding of the rear and front flaps occurs during the linear movement of the blanks which are driven by a lower and upper conveyor arrangement so that they do not jeopardize the pulling down of the flaps during the folding operation. For this folding of the front and rear flaps, the hooks of the folding device are cooperating with an upper member, usually a folding screw or, in more elaborate constructions, a set of rods with varying flexibility arranged side-by-side in the same plane, which can change form with regard to the dimensions of the flaps to be folded. Unfortunately, such an upper member, however, shows an important drawback when the production speed of the folder-gluer has been increased. The part of the flap of the box blank touching the upper members are running at a relatively high speed, whereas the element of this upper member is held in a fixed position. It doesn't matter, as long as the machine doesn't work at high speed, because the friction between the flaps and the upper member does not affect the folding condition. These things are different as soon as a high speed production is required, for example, with blanks running at a speed of 300 to 400 m/minute. The running tests have shown that this type of upper member is not appropriate as the friction and the hitting of the flaps on the elements of the upper member would cause damage or tear up the box blank which is to be folded.

SUMMARY OF THE INVENTION

The present invention is directed to providing a solution for high speed folding and maintaining of the front and rear flaps of a blank with an easy settable of the parts of the folder and gluer.

To accomplish these goals, the present invention is directed to an improvement in a device for folding and maintaining the flaps of a folded box blank, said device including upper and lower side conveyors, one central lower conveyor, and means for folding both simple and composite front and rear flaps of the blank. The improvements are that the means for folding the flaps comprise at least one flap folding and maintaining member made of a flexible material, said flexible element being a belt passed over a driving pulley, a plurality of idler pulleys and at least one tension pulley, said belt moving at a linear speed which is the same as the blank, all of the pulleys being mounted on the lateral face of a vertical plate or cheek which is supported on a tubular frame above the central conveyor, and the vertical cheek having a notch extending along the area of a portion of a run of the belt adjacent to the blank moving on the central conveyor and also having two inclined portions adjacent to said notch area.

Other advantages and features will be readily apparent from the following description, drawings and claims.

DESCRIPTION OF THE PREFERRED EMBODIMENTS

Figure 1:
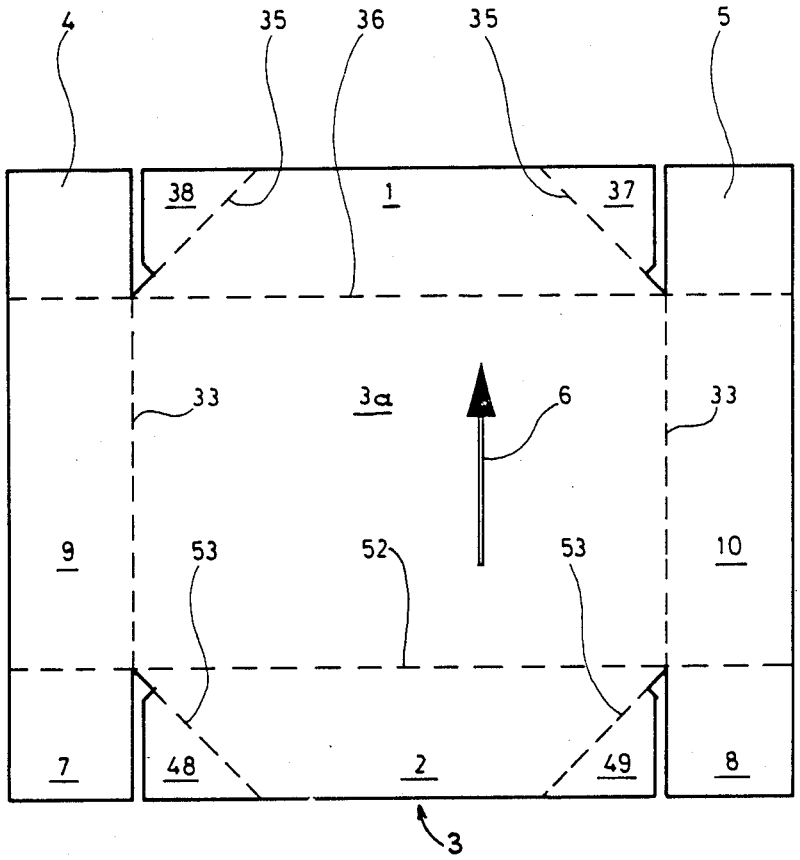
FIG. 1 is a plan view of a box blank which is to be folded in the device of the present invention.

The principles of the present invention are particularly useful in a device for folding a box blank which box blank is generally indicated at 3 in FIG. 1. The box blank 3 has a portion 3*a* defined by two parallel extending crease or fold lines 33, 33 and two transverse fold lines 36 and 52. A front complex or composite flap 1 is connected by the crease or fold line 36 to the portion 3*a*, while a back or rear composite or complex flap 2 is connected by the fold line or crease line 52. Flaps 9 and 10 are connected to the portion 3*a* by the fold or crease lines 33, 33 and simple flaps 4 and 5, 7 and 8 are formed by crease lines 36 and 52 and are connected to the flaps 9 and 10. The complex front flap 1 has glue parts 37 and 38, which are separated by diagonal extending fold or crease lines 35. In a similar manner, diagonal folding or crease lines 53, 53 form glue parts 48 and 49 on the rear complex flap 2.

When the blank 3 is moved in the direction of the arrow 6 through a folding a creasing device, the simple front flaps 4 and 5, as well as the composite front flap 1, are folded on the crease line 36. The composite rear flap 2, as well as the simple rear flaps 7 and 8, are then folded on the crease 52. During the folding of the front flap 1, the glue part 37 and 38 will be folded on the lines 35 and during the folding of the rear flap 2, the glue parts 48 and 49 will be folded on the lines 53, 53. Subsequent to this, the exposed portions of the glue parts 37 and 38, 48 and 49, are provided with an adhesive and the side flaps 8 and 10 are then folded on the crease lines 33, 33 with the simple flaps 4 and 5 then engaging the glue points 38 and 37, respectively, and the simple flaps 7 and 8 engaging the glue parts 48 and 49.

Figure 2:
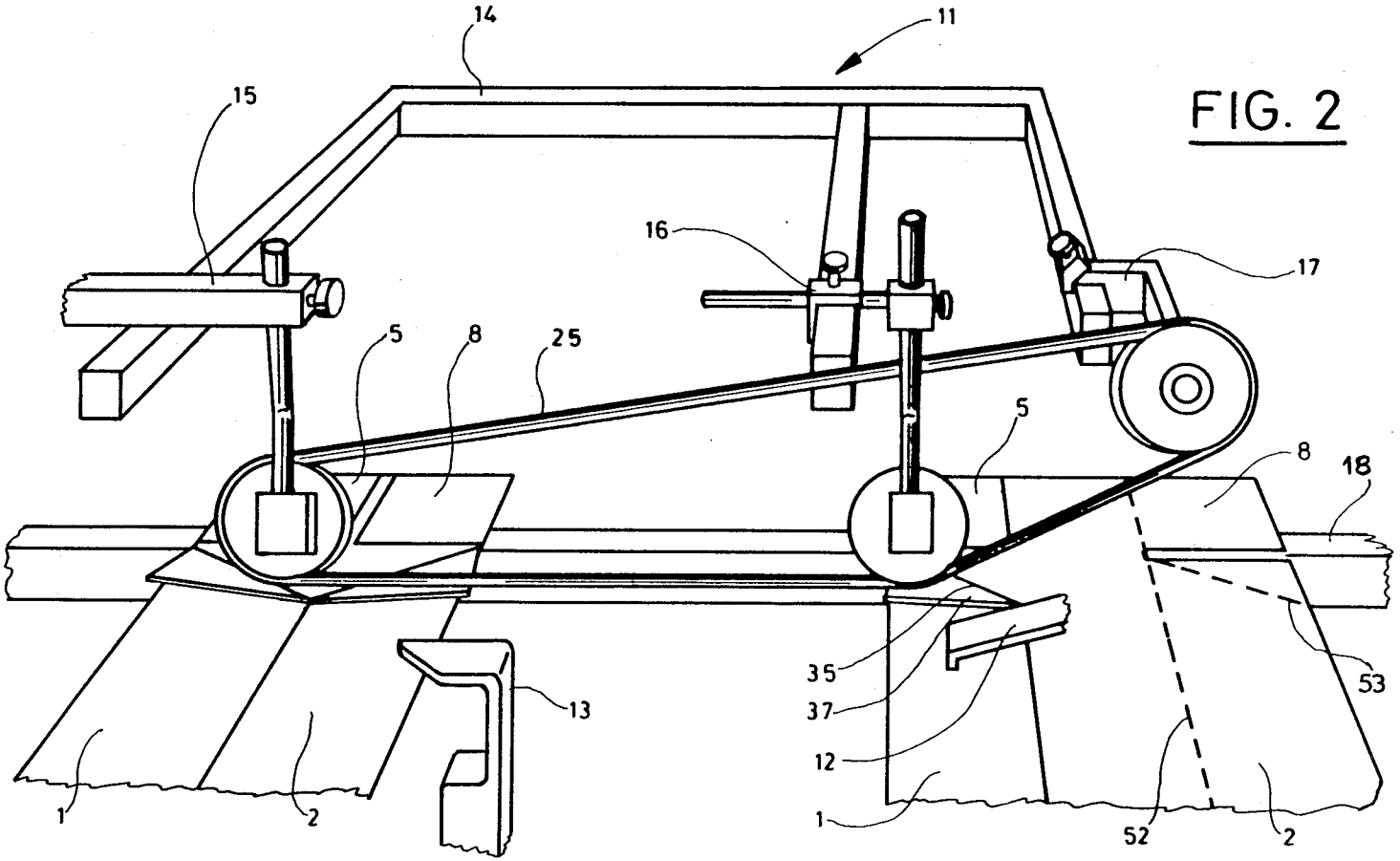
FIG. 2 is a schematic perspective view of a device for folding box blanks in accordance with the present invention.

In order to perform the various foldings, a folding unit or device 11 of FIG. 2 is utilized and the front flaps 1, 4, and 5, as well as the rear flaps 2, 7 and 8, of the box blank 3 will be folded. The unit 11 includes folding elements with front hooks 12 for engaging the leading edge of the composite front flap 1 and causes it to fold over onto the portion 3*a*. The device also includes rotative hooks such as 13, which will engage the composite back or rear flap 12 and cause it to fold over onto the portion 3*a*. The simple front and rear flaps 5 and 8 are folded with similar hooks which are not illustrated in FIG. 2. The complete folding of the composite front and rear flaps involves a folding of the flaps around the creasing lines, as well as the simultaneously folding of the parts 37 and 38, 48 and 49 of the composite flaps. Therefore, the folding unit 11 has an upper tubular frame 14 on which supporting elements such as 15, 16 and 17 are mounted for supporting the various members of the folding device 11. Of course, during the folding operation, the box blank 3 is being conveyed and held by an upper and lower conveyor, only the lower right conveyor 18 is being illustrated in FIG. 2.

Figure 3:
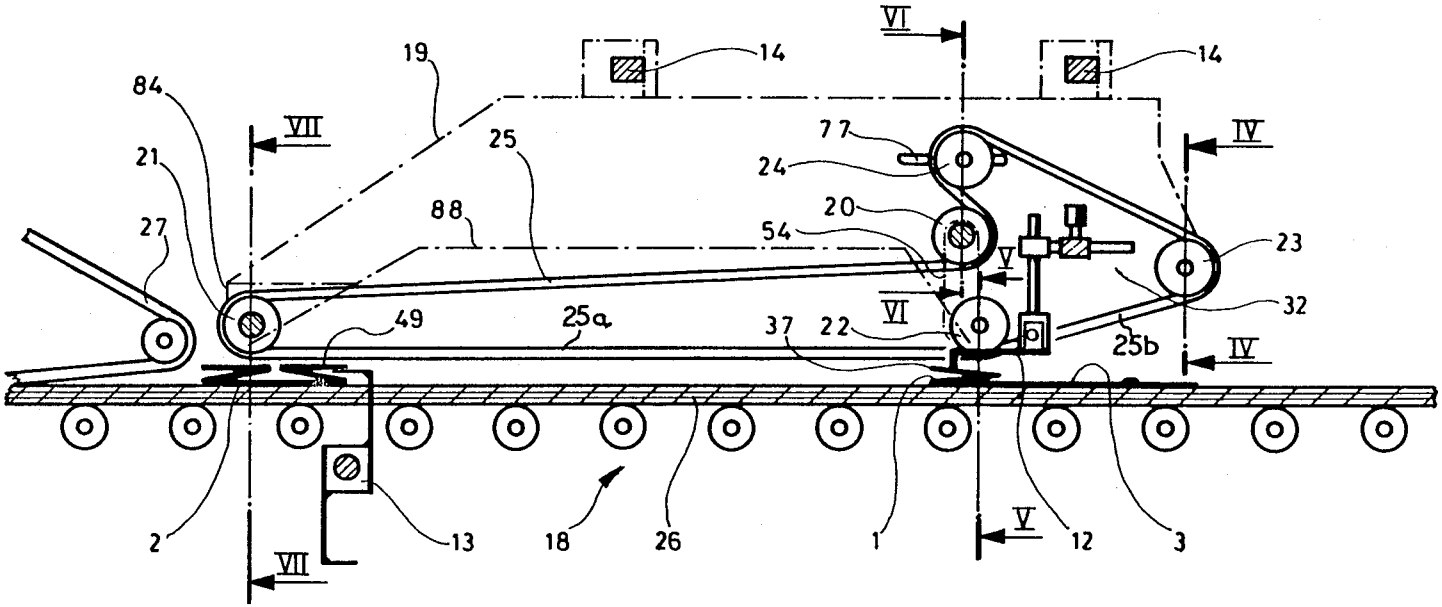
FIG. 3 is a schematic side view with portions removed for purposes of illustration of the folding and maintaining device of the present invention.

As best illustrated in FIG. 3 and the following FIGS., the folding means of the device includes a vertical cheek or plate 19, which is shown in chain lines, on which a plurality of pulleys are mounted. This includes a driven pulley 20, idler pulleys 21, 22, 23 and a tension or takeup pulley 24. A continuous belt 25 is mounted on these pulleys and has portions, such as the portion 25*a*, that move immediately adjacent and above the lower conveyor 18. The composite front flap 1 of the box blank 3 is folded by the hooks 12, while its parts 37 is being folded on itself by the engagement with the belt 25 which is moving at a linear speed almost equivalent to the running speed of a belt 26 of the lower conveyor 18. The box blank 3 is still driven by the lower conveyor 18 and is held by the folder belt 25 and is transported to the left, as illustrated in FIG. 3, where a hook 13 of the rotative folder engages the composite rear flap 2. During this operation, the part 49 of the composite flap also engages the folder belt 25 and is folded again on the composite flap 2. The folded blank is still maintained in its folded state and is conveyed by an upper conveyor 27 of the gluing unit which follows immediately after the folding device of the present invention.

Figure 4:
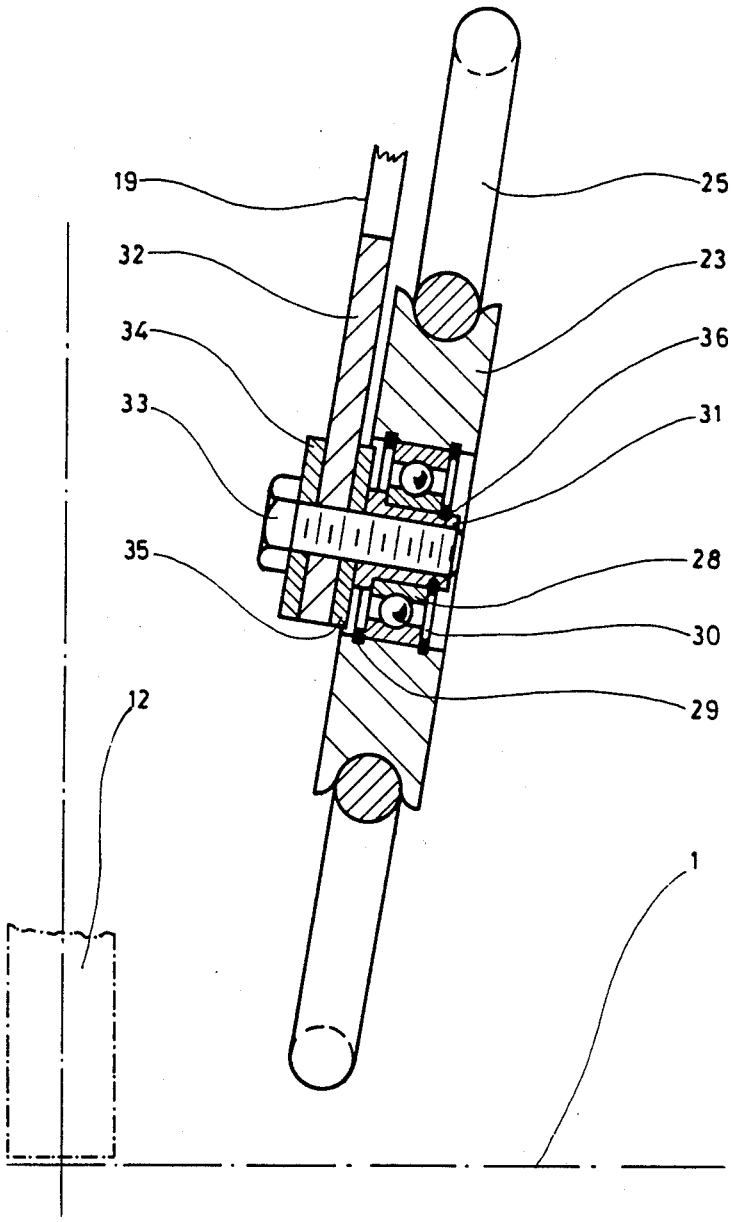
FIG. 4 is a cross sectional view taken along the lines IV—IV of FIG. 3.

As best illustrated in FIG. 4, the folder belt 25 preferably has a circular cross section and passes over a grooved pulley 23 which has a bore receiving an outer race of a ball bearing 28, which outer race is maintained in the bore by stop rings 29 and 30. The inner race of the bearing 28 is received on a tube 31, which has a shoulder at one end and is provided with an internally threaded bore. The inner race is held against the shoulder by a stop ring 36. The threaded bore of the tube 31 is threaded onto a threaded member or screw 33 which is secured in a portion 32 of the plate or cheek 19 and also has washers such as 34 and 35. While the main portion of the plate or cheek 19 extends in a vertical plane, the portion 32 extends at an angle to the vertical plane.

Figure 5:
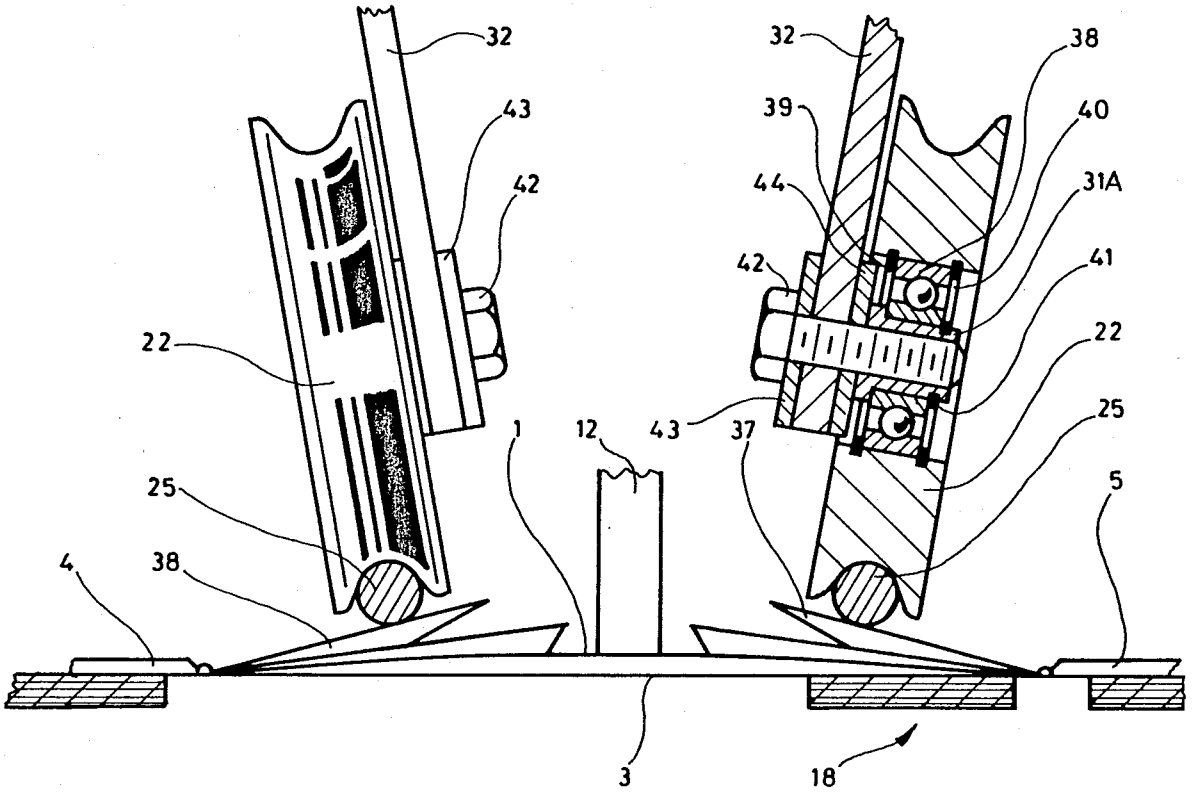
FIG. 5 is a cross sectional view taken along the lines V—V of FIG. 3.

As best illustrated in FIG. 5, the portion 32 also supports a grooved tension pulley 22. The pulley 22, like the pulley 23, has a bore which receives a ball bearing 38 and has the outer race of the ball bearing held in the bore by a pair of stop rings 39 and 40. The inner race of the bearing 38 is received on a tube 31A having a shoulder at one end and having a groove receiving a stop ring or snap ring 41. The tube 31A, as with the tube 31, has a threaded bore which receives a threaded fastener 42 which extends through a bore in the inclined part 32 and also receives washers such as 43 and 44.

As illustrated in FIG. 3, the belt 25 moves at an inclined path 25*b* between the pulley 23 and 22 and this inclined path engages parts such as 38 or 37 as the front composite flap is being folded to cause the folding of these parts on their respective fold line 35. Also as illustrated in FIG. 5, the two belts 25 are provided with one engaging the part 38 on the left side of the blank, as illustrated in FIG. 5, while the other is engaging the part 37 on the right side. As illustrated, the front folding hook 12 engages a leading edge of the front flap to cause it to be folded over.

Figure 6:
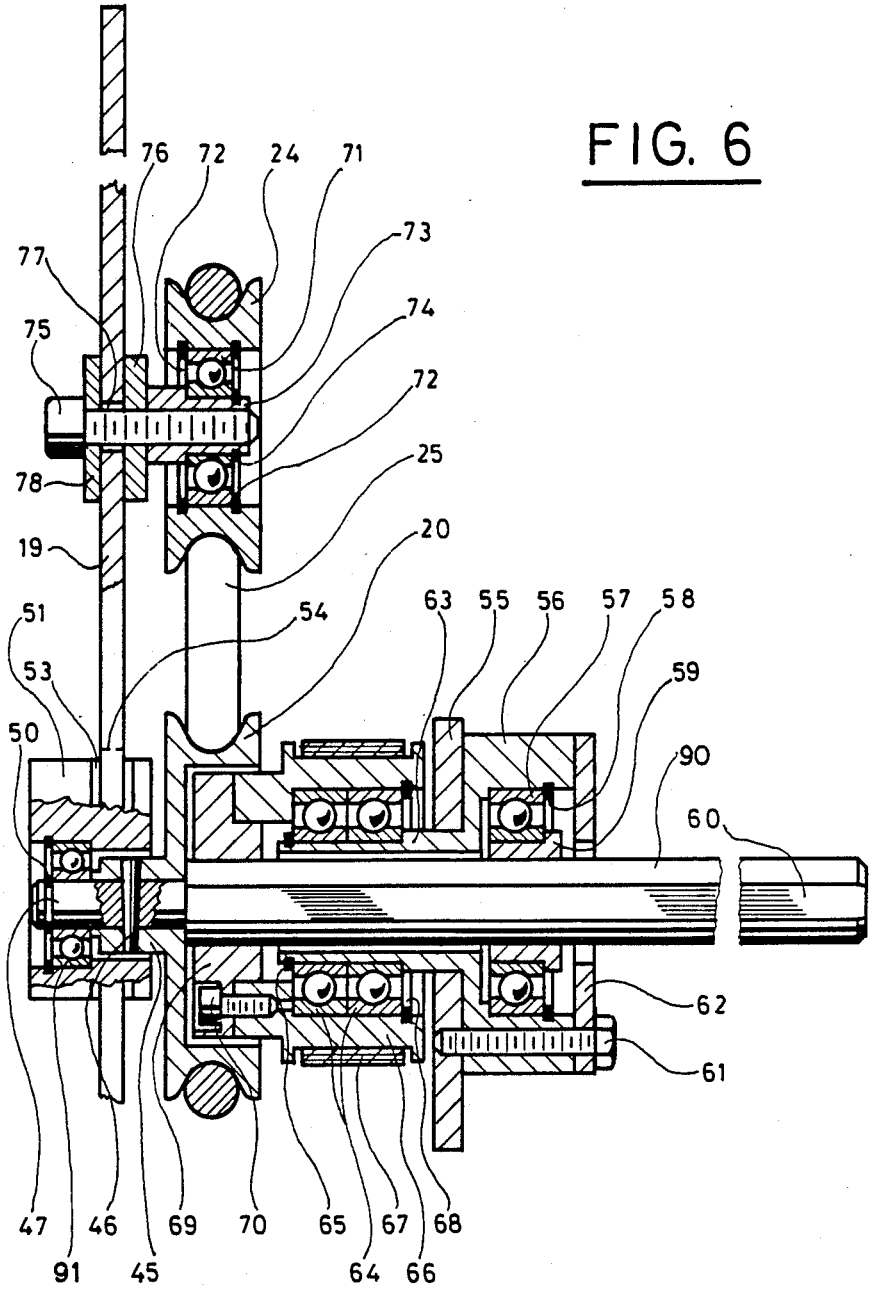
FIG. 6 is a cross sectional view taken along the lines VI—VI of FIG. 3.

The driven pulley 20 is best illustrated in FIG. 6, and includes a hub 45, which extends from one side and is fixed with a pin 46 on a projection or machined portion 47 of a transverse extending shaft 90. The projection 47 is also provided with an inner race of a ball bearing 91, which inner race is held against an end of the hub 45 by a stop ring 50. The ball bearing 91 is received in a bearing portion 51 which has a circumferential groove 53 received in a slot or fork 54, which has been formed in a vertical cheek 39 to prevent a lateral shifting of the folding and maintenance device. This construction allows the driving of the pulley 20, whereas the lateral position of the device with regard to a beam 55, which supports a bearing support 56 that supports the transverse shaft 90, can be varied. The bearing support 56 has an enlarged portion receiving a ball bearing 57 which has its outer race engaged on an internal shoulder and held by a stop or snap ring 58. The bearing 57 has an inner race received on a sleeve 59, into which the transverse shaft 90, which has two flats 60, is received. The bearing support 56 also has a sleeve extension or portion 63 with two side-by-side ball bearings 64 being positioned by being held between a shoulder on the sleeve 63 and a snap or stop ring 65. These two ball bearings 64 support a control pulley 66 which is driven by a flat belt 67, for instance the belt of one of the lateral or side conveyors of a folder-gluer (not illustrated), which is equipped with the folding and maintenance device. The control pulley 66 is positioned on the bearing 64 with the stop ring 68 holding the outer races of the bearings 64 against an internal shoulder. In order to increase the supporting distance of the shaft 90 and to drive the control pulley 66, this pulley is provided with a plate 69 which is engaged on the shaft 90. The plate 69 is secured on the control pulley 66 with a screw such as 70, and the axle can move in the plate, but transmits its motion to it by the engagement between the plate and the flats 60 of the shaft.

Above the driven pulley 20, a pulley 24 is mounted on an outer race of a ball bearing 71 by a pair of stop rings 72. The inner race of the bearing 71 is mounted on a tube 73 and held against a shoulder of the tube 73 by a stop ring 74. The tube 73 has a threaded bore which receives a screw or fastening element 75 which holds it against the washer 76 and the screw 75 is received in an oblong groove 77, which has been machined into the vertical cheek or plate 19. In addition to the washer 76, the screw 75 receives a washer 78 and the threaded arrangement can be shifted in the oblong groove 77 to change the tension on the belt 25.

Figure 7:
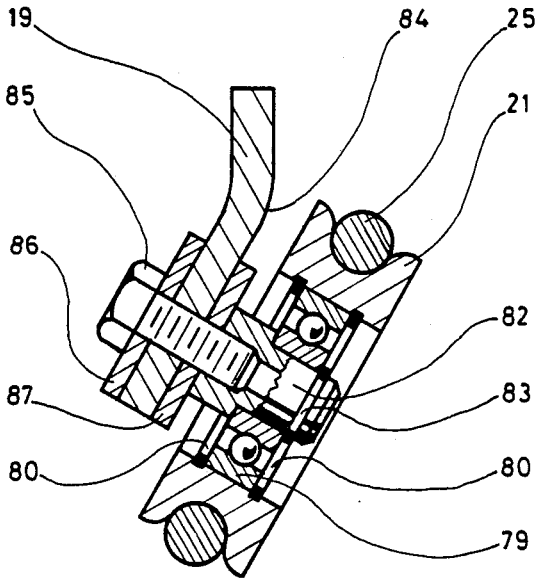
FIG. 7 is a cross sectional view taken along the lines VII—VII of FIG. 3.

The final pulley supporting the belt is the pulley 21, which is best illustrated in FIG. 7, and is mounted on an inclined portion or element 84 of the plate 19 adjacent a discharge end from the device. The pulley 21 has a bore receiving the outer race of a ball bearing 79 and the outer race is secured in the bore by a pair of stop rings 80. The belt 25 is guided in a groove which is formed in the circumference of the roller or pulley 21. The inner race of the ball bearing 79 is mounted on a stud 82 and is held against a shoulder on the stud by a stop ring 83. The stud 82 has a threaded bore which is tightened against an inclined element or portion 84 of the vertical cheek 19 by means of receiving a threaded fastener 85 which passes through washer 86 and 87. The pulley 21 and the pulley 22, as best illustrated in FIG. 3, define the horizontal portion 25*a*, which extends immediately adjacent the upper surface of the belt 26 and is used to hold the box blank as it moves therealong. In order to enable the flexible belt 25 to flex in the area or along the run 25*a*, the plate or cheek 19 is provided with a notch 88 (see FIG. 3), which extends basically between the pulleys 21 and 22.

Described hereinabove, the folding and maintaining device can also fold and maintain all the composite flaps of the box blank. Therefore, one only has to arrange on the upper frame schematically shown by the tubes 14 of FIGS. 2 and 3, the wanted number of folding devices or arrangements in a side-by-side relationship. As illustrated in FIG. 5, for instance, the two devices are provided adjacent each other for engaging the edges of the composite flaps.

The device described hereinabove simplifies the setting of the folding unit, as it does not require different folding and maintenance members every time the size of the composite flap changes. With the use of such a non-rigid folding and maintenance means, the setting up time of the various elements of the folder-gluer is reduced and, consequently, the production time will increase. Another advantage of the folding and maintenance device of the present invention is to fold the various parts of the composite blanks practically without any friction between the flap and the device because the belt 25 is driven to have a linear speed, which is approximately the same as the blank moving on the conveyor belt 26 of the central conveyor 18.

Although various minor modifications may be suggested by those versed in the art, it should be understood that I wish to embody within the scope of the patent granted hereon all such modifications as reasonably and properly come within the scope of my contribution to the art.

I claim:

1. In a device for folding and maintaining flaps of a folded box blank, said device including lower and upper side conveyors, at least one central lower conveyor for moving the box blank along a path at a predetermined speed, and means to fold both simple and composite front and rear flaps of the blank, the improvements comprising the means to fold including at least one flap folding and maintaining member made of a flexible element moving at a speed which is the same as the speed of the blank, said flexible element being a continuous belt running over a driven pulley and a plurality of other pulleys including at least one tensioning pulley, all of said pulleys being mounted on a lateral face of a vertically extending plate positioned on a frame above the central lower conveyor, said vertical plate having two elements inclined to a plane of the plate and said plate having at least one notch in an edge of the plate adjacent said path, said notch opening toward said path and being located by portion of the run of the belt which portion extends parallel to and adjacent the central lower conveyor.

2. In a device according to claim 1, wherein the driven pulley is mounted on a transverse axle slidably held in a support bearing, said support bearing rotatably supporting a control pulley with the lateral position of the folding member being modified with regard to the position of the control pulley.

3. In a device according to claim 2, wherein the driven pulley has a hub secured by a pin on a projection of the transverse axle, said projection of the transverse axle being supported in a support bearing having a peripheral groove receiving a fork associated with the vertical plate to prevent lateral shifting of the driven pulley relative to the plate.

4. In a device according to claim 2, wherein the control pulley is driven by a flat belt of one of the side conveyors.

5. In a device according to claim 1, wherein the device includes two folding and maintaining members mounted side-by-side and facing each other on the support frame and each of said members having a belt with a circular cross section.

* * * * *